US005865336A

United States Patent [19]

Krzywdziak et al.

[11] Patent Number: 5,865,336

[45] **Date of Patent: *Feb. 2, 1999**

[54] AGITATOR COVER FOR CANS OF COLORS ON PAINT SHAKER MACHINES

[75] Inventors: Alain Krzywdziak, Orleans; Yannick Tanchoux, Saint-Jean-le-Blanc, both of France

[73] Assignee: F.A.S., Orleans Cedex 2, France

[ * ] Notice: This patent issued on a continued prosecution application filed under 37 CFR 1.53(d), and is subject to the twenty year patent term provisions of 35 U.S.C. 154(a)(2).

[21] Appl. No.: 727,924

[22] Filed: Oct. 9, 1996

[30] Foreign Application Priority Data

Oct. 24, 1995 [FR] France ..... 95 12498

[51] Int. Cl.[6] ..... B65D 45/16

[52] U.S. Cl. ..... 220/324; 220/315; 220/378

[58] Field of Search ..... 220/243, 245, 220/247, 250, 251, 314, 315, 324, 325, 378

[56] References Cited

U.S. PATENT DOCUMENTS

| | | | |
|---|---|---|---|
| 1,212,878 | 1/1917 | Augenbraun | 220/324 X |
| 2,263,842 | 11/1941 | Gross | 220/324 |
| 2,263,843 | 11/1941 | Gross | 220/324 X |
| 2,593,712 | 4/1952 | Wells et al. | 220/314 X |
| 2,950,141 | 8/1960 | Koff | 220/245 X |
| 5,335,806 | 8/1994 | Dedoes . | |
| 5,603,426 | 2/1997 | Krzywdziak et al. | 220/324 |

FOREIGN PATENT DOCUMENTS

| | | |
|---|---|---|
| 0 649 760 A1 | 4/1995 | European Pat. Off. . |
| 2603255 | 4/1988 | France . |

*Primary Examiner*—Stephen K. Cronin
*Attorney, Agent, or Firm*—Scully, Scott, Murphy & Presser

[57] ABSTRACT

An agitator cover for cans of colors positionable on shaker machines, wherein the cover mounts at its base a peripheral flexible joint (11) which, upon closure of the agitator cover on the can (5), is applied on the external peripheral edge (13, 13') of the ring-shaped rim (7, 7') defining the opening of the can (5). The joint (11) include a ring-shaped anterior body part (17) which is attached to the base of the cover and upon closure under pressure is applied in a sealing manner on the peripheral edge (13, 13') of the can, and a flexible internal ring-shaped lip (19) which is integrally connected with the anterior body part (17) and extending coaxially with the body part (17), and upon closure is applied onto the internal edge (15, 15') of the ring-shaped opening rim (7, 7') of the can.

11 Claims, 1 Drawing Sheet

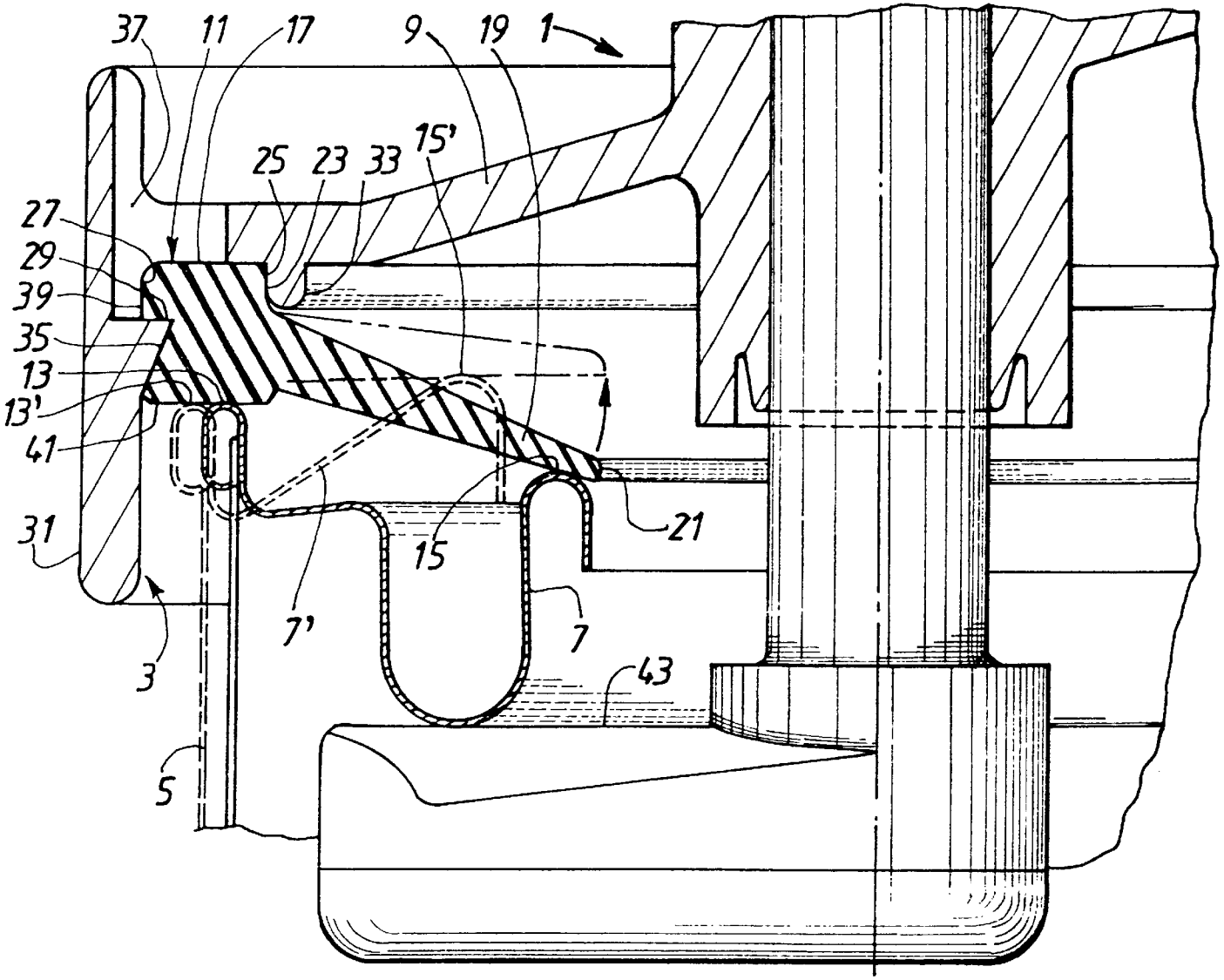
1
19
9
15'
33
23
25
17
11
37
27
29
39
35
13
13'
41
31
21
15
7
7'
43
3
5

AGITATOR COVER FOR CANS OF COLORS ON PAINT SHAKER MACHINES

BACKGROUND OF THE INVENTION

1. Field of the Invention

The present invention concerns agitator covers for cans of colors fitting paint shaker machines, and, in particular, an agitator cover of the type comprising at its base a peripheral flexible closure joint, intended to be applied tightly, with sealing, to the corresponding upper opening edge of cans of color, which can be adapted to the diverse existing cans of colors and with improvement of the closure on their rim.

2. Discussion of the Prior Art

It is known that cans of colors have an upper peripheral opening rim in cooperating in closure with the closure cover of the can and thus the sectional profile of the rim is variable from the classic U shape to the shape of an inverted v.

The known agitator covers of the flexible closure joint type on the underlying can do not permit application upon closure on the crimping listel of the peripheral upper edge of the opening rim of the can.

However, this application on the crimping listel of the edge of the opening rim of the can cannot prevent the entry of the paint into the cavity of the rim, for example, during the inclination of the container during the maneuver of pouring the paint by means of the cover, nor the contamination resulting from the formation of amalgams upon drying of the paint contained in the can.

SUMMARY OF THE INVENTION

The invention aims to overcome this drawback and proposes an agitator cover for cans of colors on shaker machines, of the type comprising at its base a flexible peripheral joint, intended to be applied, upon closing of the agitator cover on the can, on the external peripheral edge of the ring-shaped rim delimiting the opening of the can, characterized in that said joint comprises a part of the anterior ring-shaped body attached to said base of the cover and intended to be applied upon closure under pressure and in a sealing manner to said peripheral edge of the can, and a flexible internal ring-shaped lip which is integrally connected to said anterior body part, coaxial with the body part, and intended to be applied upon closure on the internal edge of the opening ring-shaped rim of the can.

Thanks to this arrangement, the flexible lip is applied upon closure of the cover on the can on the internal edge of the opening rim of the can by corresponding to the shape of its profile and thus constitutes a second closure sealing zone, complementary to the first sealing zone constituted by the application of said body part to the peripheral edge of the can; this arrangement prevents paint from entering the interior of the cavity of the edge during the maneuver of the agitator cover with the can of color.

According to advantageous characteristics of the invention the flexible lip is formed in a monobloc fashion with said anterior part of the body of the joint, for example, by molding with the latter out of a flexible synthetic material resistant to paint solvents.

This flexible lip has a regular sectional profile which is tapered toward the interior and is directed toward the bottom in a natural position at an angle of slope determined relative to the plane of the joint, slightly above the maximum slope line between the peripheral and internal edges of the rim of the existing cans of colors. This angle can be approximately thirty degrees.

It is, in addition, angularly mobile with elastic return to the natural position, thus adapting to the various profiles of can rims becoming, at the maximum, approximately horizontal, while being applied to the internal edge of the opening rim of the can. In addition, this lip has a radial length which is slightly greater than the greatest radial length between the upper external edge and the internal edge of the opening rim of the cans, and for example, about 15 mm. Thanks to this arrangement, the cover according to the invention can be adapted, upon closure, to all the cans of colors existent on the market.

The anterior body part of the joint is preferably attached, with elastic engagement, by snapping into a complementary housing formed at the base of the cover.

The latter comprises a peripheral external vertical skirt forming a projection toward the bottom relative to the joint for the centering of the closure of the cover on the can. This arrangement facilitates the rapid assembly of the joint and the maneuver of assembly of the cover on the can of color.

BRIEF DESCRIPTION OF THE DRAWING

The invention is illustrated below with the aide of an embodiment example and with reference to the attached drawing, in which:

The single figure is a partial section of a cover according to the invention applied, upon closure, to a can of color, represented only at the level of its base or edge on the rim of the can because of the circular symmetry, respectively on the two opening rims in full lines and in dot-and-dash lines, delimiting the two extreme forms of the opening rim of the cans of colors.

The FIGURE shows a partial radial section of the cover 1 according to the invention, at the level of its closure edge 3, applied respectively on a can of color 5 comprising an opening rim 7 of U shape in full lines and of inverted V shape 7' in dot-and-dash lines. The assembly comprises a rotational symmetry with respect to the median axis of the cover (or the can). The agitator cover is classic, comprising a body 9 having the general shape of a cap opening toward the base, provided with an incorporated pouring spout and an axial sheath for axial passage of an agitator shaft (not shown). It comprises, at a small distance from its peripheral circular edge 3 and on its base, a ring-shaped sealing joint by which it can be assembled closed with sealing on the opening of the underlying can of color 5. The latter comprises, at its opening, as mentioned above, an internal ring-shaped rim 7 of variable shape according to the makers, that can be in the classic U shape (full lines) or developed in an inverted V shape (dot-and-dash lines). This metallic rim is integrally connected to the wall of the can 5 by an upper peripheral ring-shaped crimping ledge 13 and comprises, moreover, an internal extreme edge 15 rounded toward the top, and the crest of whose fold is turned the bottom in the vertical direction.

The joint is made of a synthetic elastomer material which is resistant to solvents, of the thermoplastic type injected under pressure. Polysulfone composites are suitable for this purpose. It comprises, in section, a thick anterior body part 17 and a lip 19 tapered back and directed toward the bottom, the assembly being formed in a ring-shaped fashion with symmetry with respect to the median axis. The anterior body part 17 has a generally square-shaped section, and the lip 19 is triangular with one part forming an external apex 21. This lip is an integral part of body part 17 by its back face 23 with slight detachment of the surface at the lower level and a shoulder 25 at the upper level. The joint is attached at the base of the cover by its body part which is elastically engaged by snapping into a complementary receptacle 27 formed in it. The joint 11 is introduced by pushing it into its receptacle 27 and it automatically engages due to the effect of the interior retainer teeth 29 formed on the internal wall of the peripheral vertical skirt 31 of the border of the cover and by the support, in opposition to the retainer teeth, of a ring-shaped rib 33 formed inside the cover and in abutment against the shoulder 25. The teeth 29 are of triangular shape with the apex directed toward the top and the interior, allowing the plugging in of body part 17, which, by means of a ring-shaped groove 35 with a section complementary to the teeth, receives the latter and is then maintained in place. It should also be noted, in another connection, that the molding of the cover from plastic material compels the provision of upper ejector pieces for the release of the mold for making the covers because of the internal teeth (for breaking open the mold), these pieces, once removed, uncovering an empty part 37 closed by the body part 17 of the joint.

The teeth 29, of small width, 3–4 mm, are regularly arranged on the periphery of the cover, for example, according to an angle of approximately 30°–40°, and they grip approximately at the middle of the anterior side 39 of the body part 17.

It is not necessary for the lower face 41 of the body part to be of considerable width, because the position of the crimping edge 13 of the opening rim of the cans on the market varies little in size. This is apparent in the drawing, where the edges, respectively in full lines 13 and in dot-and-dash lines 13'representing the extreme limits of the dimensions of these edges, are slightly spaced one from the other. The positioning of this body part 17 is advantageously on the base of the cover in such a manner that the crimping edge 13 comes to bear upon closure of the cover on the can, approximately in the median part of the lower face 41 of this body part, and thus in a location remote from the corners.

The peripheral vertical skirt 31 of the cover making a projection toward the base of the body part 17 favors the centering of the application of the joint, both on the body part 17 and on the lip 19 which bears pressure toward the base, upon closure, on the internal edge 15 of the rim.

The length in radial section of this lip is relatively large, for example, 1.5 cm, in order to adapt to all the opening rim profiles of existing cans. In particular, U profile 7, represented in full lines, comprises the greatest distance between the edges 13,15 of the rim.

The lip 19 can comprise an internal elastic metallic core (not shown) favoring the return pressure on the internal edge 15 and thus the sealing upon closure at this level.

This lip is naturally mobile by the angular elasticity of the body part 17 in order to adapt in height to the internal edge of the rim. The maximum height is illustrated by the rim 7' in an inverted V in dot-and-dash lines where the lip comes approximately into a horizontal position on the internal edge 15'. In its natural position, the lip is directed toward the inside and toward the base according to an angle of about 30° relative to the plane of the joint.

The closure of the cover is obtained in the classic manner by tightened application of the cover on the opening rim of the underlying can of color by means of rotary cams 43 regularly arranged on the periphery of the cover and bearing under the rim 7 of the can.

The double seal obtained upon closure by the body part 17 of the joint on the peripheral crimping edge 13 and by the lip 19 on the internal edge 15 of the rim prevents, at the maneuver of the cover with the can, the paint from going into the rim and, as mentioned above, the resulting contamination upon drying of the paint contained in the can.

We claim:

1. Agitator cover for cans of colors which are positionable on shaker machines, said cover comprising a peripheral flexible joint (11) attached to a base of said cover, said flexible joint upon closure of the agitator cover on the can (5), being applied at least on an external peripheral edge (13, 13') of a ring-shaped rim provided with an internal edge (15, 15') and defining an opening of the can (5), said joint (11) including an anterior ring-shaped body part (17) which is attached to said base of the cover and upon closure of said cover on said can is applied under pressure and in a sealing manner on said external peripheral edge (13, 13') of the can, the location of the body part (17) being provided on the base of the cover such that said external peripheral edge (13, 13') comes to bear upon closure of the cover on the can. approximately in the median part of a lower face (41) of said body part, and in a location remote from corners of said body part, and said joint including a flexible internal ring-shaped lip edge (19) which is integrally connected to said anterior body part (17), extends coaxially with the body part (17) and upon closure of the cover on the can is sealingly applied with a lower surface thereof onto said internal edge (15, 15') of the ring-shaped opening rim (7, 7') of the can.

2. Agitator cover according to claim 1, wherein the lip (19) comprises an internal elastic core.

3. Agitator cover according to claim 1, wherein the anterior body part (17) of the joint is attached with elastic engagement, by snapping into a complementary receptable (27) formed at the base of the cover.

4. Agitator cover according to claim 1, wherein the base of the cover comprises a peripheral external vertical skirt (31) forming a projection toward the base relative to the joint (11).

5. Agitator cover according to claim 1, wherein the flexible lip (19) has a radial length which is greater than the greatest radial distance between the external peripheral edge (13) and the internal edge (15) of the opening rim of the can.

6. Agitator cover according to claim 5, wherein the radial length of said lip is greater by about 15 mm than the greatest radical distance between the external peripheral edge and the internal edge of the opening rim of the cans.

7. Agitator cover according to claim 1, wherein the base of the cover comprises a peripheral external vertical skirt (31) forming a projection toward the base relative to the joint (11).

8. Agitator cover according to claim 7, characterized in that the anterior body part (17) of the joint is maintained attached in its housing (27) by retainer teeth (29) of the cover with the point directed toward the top and the interior, at the level of the median part of the anterior face (39) and by support in opposition to the shoulder (25) in abutment on an axial circular rib (33) formed inside the cover.

9. Agitator cover according to claim 1, wherein the flexible lip (19) is formed in monobloc fashion with said anterior body part (17) of the joint by molding with the latter out of a flexible synthetic material resistant to paint solvents.

10. Agitator cover according to one of claims 1 or 2, wherein the flexible lip (19) has a regular sectional profile which is tapered toward the interior and is directed toward the base in a natural position at an angle of slope determined relative to the plane of the joint (11), slightly above the maximum slope line between the peripheral (13, 13') and internal (15, 15') edges of the rim (7, 7') of the existing cans of colors.

11. Agitator cover according to claim 10, wherein the angle of said slope is about 30°.

* * * * *